US006891130B2

(12) United States Patent
Evanyk

(10) Patent No.: US 6,891,130 B2
(45) Date of Patent: May 10, 2005

(54) APPLIANCE FOR DISPENSING MELT ADHESIVE WITH VARIABLE DUTY CYCLE AND METHOD OF IMPLEMENTING

(76) Inventor: Walter Evanyk, 3200 Sherrye Dr., Plano, TX (US) 75074

( * ) Notice: Subject to any disclaimer, the term of this patent is extended or adjusted under 35 U.S.C. 154(b) by 91 days.

(21) Appl. No.: 10/409,555

(22) Filed: Apr. 7, 2003

(65) Prior Publication Data

US 2003/0205566 A1 Nov. 6, 2003

Related U.S. Application Data

(60) Continuation-in-part of application No. 10/117,776, filed on Apr. 5, 2002, now Pat. No. 6,718,651, which is a division of application No. 09/662,860, filed on Sep. 15, 2000, now Pat. No. 6,449,870.

(51) Int. Cl.[7] ..... H05B 3/00; H05B 1/02

(52) U.S. Cl. ..... 219/240; 219/492; 222/146.5

(58) Field of Search ..... 219/240, 492, 219/241, 497, 494; 222/146.5, 146.2; 401/1, 2; 433/32

(56) References Cited

U.S. PATENT DOCUMENTS

| | | | | |
|---|---|---|---|---|
| 3,651,413 A | | 3/1972 | Wycoff | |
| 3,666,921 A | * | 5/1972 | Shevlin | 219/492 |
| 3,750,905 A | * | 8/1973 | Wolfrom | 222/23 |
| 4,059,204 A | | 11/1977 | Duncan et al. | |
| 4,243,875 A | * | 1/1981 | Chang | 219/497 |
| 4,267,914 A | | 5/1981 | Saar | |
| 4,338,769 A | * | 7/1982 | Jones | 53/509 |
| 4,348,583 A | * | 9/1982 | Bube et al. | 219/497 |
| 4,523,705 A | | 6/1985 | Belanger et al. | |
| 4,527,560 A | * | 7/1985 | Masreliez | 606/31 |
| 4,546,235 A | * | 10/1985 | Kolter | 219/230 |
| 4,576,553 A | | 3/1986 | Winston et al. | |
| 4,755,792 A | | 7/1988 | Pezzolo et al. | |
| 4,857,702 A | * | 8/1989 | Cafaro | 219/225 |
| 4,893,067 A | | 1/1990 | Bhagwat et al. | |
| 4,968,870 A | * | 11/1990 | Moon | 219/222 |
| 5,086,526 A | | 2/1992 | Van Marcke | |
| 5,277,261 A | | 1/1994 | Sakoh | |
| 5,289,885 A | | 3/1994 | Sakoh | |
| 5,410,229 A | | 4/1995 | Sebastian et al. | |
| 5,440,215 A | | 8/1995 | Gilmore | |
| 5,462,206 A | | 10/1995 | Kwasie | |
| 5,472,721 A | * | 12/1995 | Eisenberg et al. | 426/243 |
| 5,526,460 A | | 6/1996 | DeFrancesco et al. | |
| 5,731,673 A | | 3/1998 | Gilmore | |
| 5,928,536 A | * | 7/1999 | Lee | 219/229 |
| 5,937,622 A | | 8/1999 | Carrier et al. | |
| 5,943,712 A | | 8/1999 | Van Marcke | |
| 5,945,803 A | | 8/1999 | Brotto et al. | |

(Continued)

FOREIGN PATENT DOCUMENTS

| | | | |
|---|---|---|---|
| FR | 2515068 | * | 4/1983 |
| JP | 55-112165 | * | 8/1980 |

*Primary Examiner*—John A. Jeffery
(74) *Attorney, Agent, or Firm*—Jones Day

(57) ABSTRACT

The present invention relates to a portable adhesive dispensing appliance with adjustable duty cycle. Rather than applying power continuously to the heating element, the element power is intermittently switched over to a variable duty cycle. Savings are gained in three areas: extended life of the element; less heat lost to thermal radiation; and less adhesive waste due to dripping and overheating. The duty cycle may be adjusted manually or automatically based on the temperature of the adhesive in the melt chamber. Additionally, the voltage and/or current to the heating element may be adjusted, either manually or automatically, for more rapid recovery during high usage periods. Higher throughput is achieved by sensing the temperature, comparing the temperature to a desired temperature, and then increasing the duty cycle by either or both one of increasing the frequency of duty pulses and/or lengthening the duration of the duty pulses.

21 Claims, 3 Drawing Sheets

U.S. PATENT DOCUMENTS 5,980,144 A * 11/1999 DeBourg et al. ..... 401/1
6,010,228 A 1/2000 Blackman et al.
6,142,207 A 11/2000 Richardot
6,178,572 B1 1/2001 Van Marcke
6,242,889 B1 6/2001 Belyo
6,286,609 B1 9/2001 Carrier et al.
6,296,065 B1 10/2001 Carrier
6,353,705 B1 3/2002 Capps et al.
6,406,168 B1 6/2002 Whiting
6,424,799 B1 7/2002 Gilmore
6,449,870 B1 9/2002 Perez
6,460,626 B2 10/2002 Carrier
6,479,958 B1 11/2002 Thompson et al.
6,524,102 B2 * 2/2003 Davis ..... 433/32
6,538,403 B2 3/2003 Gorti et al.
6,616,448 B2 * 9/2003 Friedman ..... 433/32

* cited by examiner

APPLIANCE FOR DISPENSING MELT ADHESIVE WITH VARIABLE DUTY CYCLE AND METHOD OF IMPLEMENTING

CROSS REFERENCES TO RELATED APPLICATIONS

The present application is a continuation in part of and claims priority from the following U.S. patent applications:

U.S. patent application entitled "Portable Hair Dryer" having application Ser. No. 10/117,776, and filed on Apr. 5, 2002, now U.S. Pat. No. 6,718,651, which is a divisional of U.S. Ser. No. 09/662,860 now U.S. Pat. No. 6,449,870 entitled "Portable Hair Dryer" and filed on Sep. 15, 2000. The above-identified applications are incorporated by reference herein in their entirety.

BACKGROUND OF THE INVENTION

1. Field of the Invention

The present invention relates in general to a hot glue dispenser or "glue gun." More specifically, the present invention is related to a hot glue dispenser and a voltage regulating circuit to control the heat produced by the element, but also has a power control circuit that allows the heating element to obtain fill heat and then pulses it to maintain the set heat which reduces the power consumption.

2. Description of Related Art

A hot glue dispenser, or gun, is an appliance for liquefying and dispensing thermoplastic materials such as hot melt adhesives and glues from their solid phase through the controlled application of heat energy. The liquefied glue, or "melt," is then in a readily usable form for application to a workpiece. Typically, prior art glue guns are comprised of three major parts: the body; the electrical power circuit components, e.g., the heating element(s) and control(s); and the mechanical components, e.g., the glue path and application mechanism. The mechanical components associated with a typical glue gun are described in U.S. Pat. No. 4,523,705 issued to Belanger et al. entitled "Mechanism for Glue Gun," which is incorporated herein by reference in its entirety. Normally, the type of glue selected is dictated by the particular type of glue gun used for dispensing the gun. One popular form of glue is the hot melt "glue stick" which is elongated cylindrically shaped thermoplastic material which is received in a portable hot melt glue gun at a similarly shaped receiving end in the glue path. Further along the glue path is the melt chamber which is surrounded by one or more electrical heating elements for communicating radiant heat energy to the melt chamber and thermoplastic material therein. A mechanical feed mechanism is typically provided within the body for applying pressure to the solid portion of the flexible thermoplastic rod for forcing it along the glue path, into the melt chamber and finally dispensing the melt through an exit nozzle onto, for instance, a workpiece. The glue may also be of the "cool" melt type which liquefies at a lower temperature than hot melt type glue. Hot melt adhesives are appropriate for high temperature glue guns that typically operate at approximately 380° F. (193° C.) and are used for most bonding applications, craft projects, floral arrangements, repairs, and on most materials such as paper, wood, plastics, etc. The melting point of a hot melt adhesive is lower than 380° F. to ensure that the glue is melted and dispensable from a 380° F. chamber. Cool melt adhesives, on the other hand, are appropriate for low temperature glue guns that typically operate at approximately 225° F. (107° C.) and are recommended for use on heat sensitive materials such as styrofoam, balloons, and fabrics.

A typical prior art glue gun is permanently configured for either hot or cool melt applications, although some prior art glue guns have dual temperature switching capability.

The temperature of the glue in the melt chamber is determined by three basic factors: heat energy in, i.e., the amount and time heat is applied to the chamber; heat energy out, i.e., the heat loss of the gun, glue path and amount of glue dispensed; and heat energy absorbed, i.e., the thermal properties of the glue enabling it to change phases. A distinction should be understood between the temperature and heat energy. Temperature is a measure of the average amount of motion per molecule, or concentration of heat, while heat energy is a quantity of heat. Temperature is graduated in degrees and heat in calories such that one calorie is the quantity heat energy required to raise the temperature of one gram of water one degree C.

Prior art glue guns generally rely on a relatively uncomplicated electrical power circuit for regulating the heat of the glue, the most simple of which utilizes a fixed temperature heating element operating at a predetermined fixed temperature, say 380° F. (193° C.), which is electrically coupled to a power source. However, two heating elements may operate at the identical fixed temperature and still produce different levels of heat energy, e.g., by employing high capacity heating elements. For example, two glue guns with heating elements operating at the identical fix temperature of 380° F. might, but if one has a larger capacity heating element, it will be capable of liquefying more glue in the same time period.

Other prior art glue gun power circuits are only slightly more complicated than that described above. One exemplary power circuit used a thermostat, or other heat-sensing device, for regulating electrical power to the heating element. That power circuit consists of an optional switch connected between a power source and a thermostat, and a heating element electrically coupled between the thermostat and power source. With a thermostat protecting the glue from overheating, heating elements may be employed which operate at a much higher temperature. The combination of higher operating temperature and larger capacity elements enables higher volumes of glue to be emulsified and dispersed in a comparable time period.

Throughput, the volume of glue a gun is capable of liquefying and dispersing in a set time period is a continual problem plaguing glue gun manufacturers. Incorporating larger capacity heating elements in a gun increases throughput, but substantially increase the cost of the gun. Heating elements with higher operating temperatures are also more expensive and have the added disadvantage of reacting with thermoplastics that cannot tolerated a higher temperature in the melt chamber. This is especially true for colored adhesives.

One solution for increasing throughput is described by U.S. Pat. No. 4,059,204 issued to Duncan et al. entitled "System for Dispensing and Controlling the Temperature of Hot Melt Adhesive." Duncan discloses a hot melt glue gun which includes an electronic circuit enabling the gun operator to set a desired temperature to which the glue is heated. The set point is automatically raised to a predetermined amount when the glue is flowing in order to compensate for the drop in temperature caused by the loss of heat to the glue and atmosphere.

Another solution for increasing throughput and lowering the glue gun costs is by incorporating a head sink in the melt chamber. The heat sink absorbs latent heat which would otherwise be exhausted to the ambient air when the melt chamber is at higher temperatures, for instance during idle periods when glue is not passing through the glue path, and then releases the heat energy back into the melt chamber when the glue passing through it is at a lower temperature than the sink, such as during active periods when large volumes of glue are passing through the glue path. Other improvements to the melt chamber are disclosed in U.S. Pat. No. 5,462,206 issued to Kwasie entitled "Melting Assembly for Thermoplastic Materials," which is incorporated herein by reference in its entirety. While the heat sink increases throughput somewhat, with only a marginal increase in cost, additional operation costs can easily surpass initial savings in gun costs. This happens because with the addition of the sink, the surface area of the high temperature portion of the gun is also increased, thereby increasing the area of the gun exposed to the cooler ambient air, and increasing heat loss. Additionally, heat losses result from transferring the heat energy from the element to the sink, then to the chamber and, then finally to the glue which decreases the overall efficiency of the gun. Thus, while the sink may lower the initial glue gun cost through the use of smaller capacity and/or lower operating temperature heating elements, the guns are considerably inefficient.

Other prior art references describe increasing the efficiency of glue guns by identifying areas of high heat loss and insulating them, thereby increasing efficiency of heat energy transfer into and retained in the melt adhesive, such as U.S. Pat. No. 6,142,207 issued to Richardot entitled "Hot Melt Glue Applicator and Glue Stick for Use Therein," which is incorporated herein by reference in its entirety. However, each prior art glue gun suffers from a paradox, attempting to increase throughput results in more expensive initial costs and substantially higher operating expenses, due to the inherent inefficiencies of the gun. While, setting for lower throughput results in higher lag times, which in turn increases operating expenses due to the operator's increased idle time.

SUMMARY OF THE INVENTION

The present invention relates to an adhesive dispensing appliance with adjustable duty cycle. Rather that applying power continuously to the heating element, the element power is intermittently switched over a variable duty cycle. Savings are gained in three areas: extended life of the element; less heat lost to thermal radiation; and less adhesive waste due to dripping and overheating. The duty cycle may be adjusted manually, or automatically based on the temperature of the adhesive in the melt chamber. Additionally, the voltage and/or current to the heating element may be adjusted, either manually or automatically, for more rapid recovery during high usage periods. Higher throughput is achieved by sensing the temperature, comparing the temperature to a desired temperature, and then increasing the duty cycle by either or both one of increasing the frequency of duty pulses and/or lengthening the duration of the duty pulses.

BRIEF DESCRIPTION OF THE DRAWINGS

The novel features believed characteristic of the present invention are set forth in the appended claims. However, the invention itself, as well as a preferred mode of use, further objectives and advantages thereof, will be best understood by reference to the following detailed description of an illustrative embodiment when read in conjunction with the accompanying drawings wherein:

Other features of the present invention will be apparent from the accompanying drawings and from the following detailed description.

DETAILED DESCRIPTION OF THE INVENTION

Figure 1:
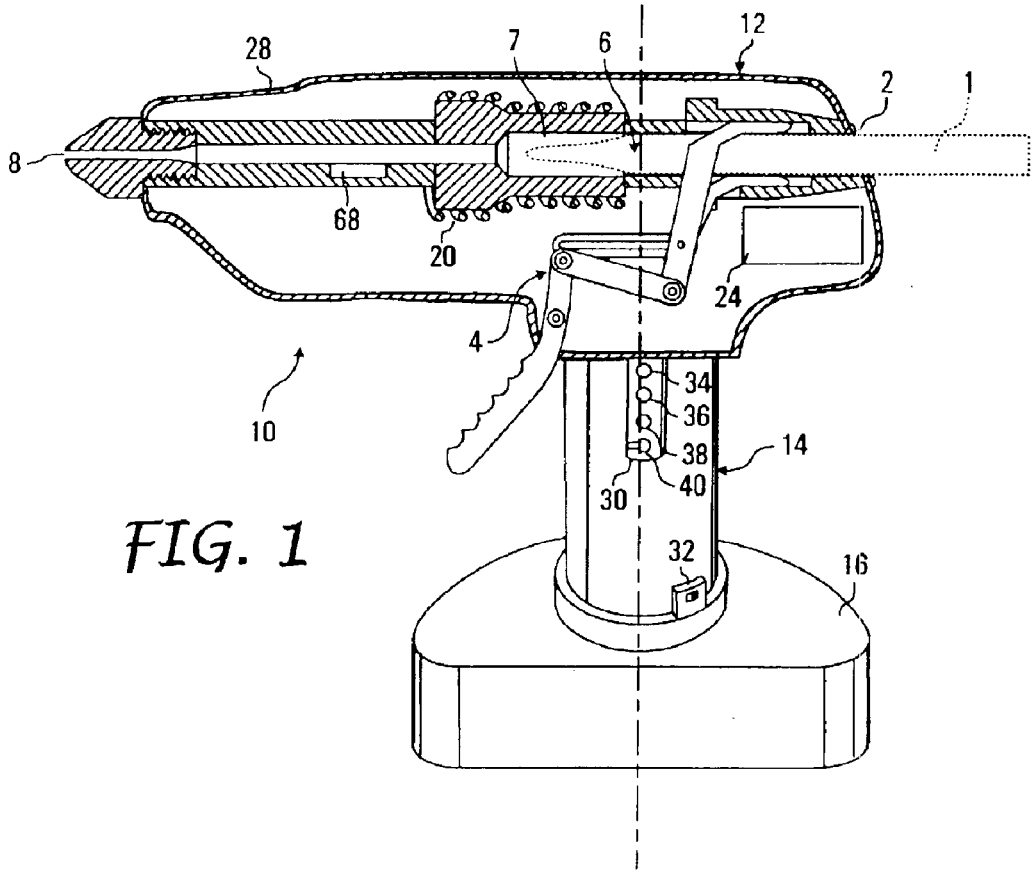
FIG. 1 is a perspective view of the novel hot adhesive dispenser appliance for liquefying and dispensing thermoplastic materials in accordance with exemplary embodiments of the present invention.

FIG. 1 is a perspective view of novel adhesive dispensing appliance 10 including body portion 12, handle portion 14 and battery base portion 16. It will be noted that mass center line 18 of each of hollow body portion 12, handle 14, and battery base 16 are all in alignment thus allowing unit 10 to be balanced and enables the adhesive dispensing appliance to stand alone on base 16. In addition, by the alignment of the mass center lines of elongated hollow body portion 12, handle 14 and base 16, and proper weight distribution of hollow body portion 12 and base 16 as can be done by those skilled in the art, balance is provided to enable the unit to be used with minimum strain on the arm and hand of the user.

Contained within hollow body portion 12 are the electrical power circuit components for heating the adhesive and the mechanical components for dispensing the melted adhesive. In accordance with an exemplary embodiment of the present invention, the electrical power circuit components comprise heating element 20, pulsing circuit 24 and temperature sensor 68. With particular regard to the exemplary depicted as adhesive dispensing appliance 10, a portable type of "glue gun" which utilizes hot melt glue sticks, elongated cylindrically shaped thermoplastic glue stick material 1 is received at opening 2 of glue path 6. Further along glue path 6 is melt chamber 7 which is surrounded by one or more electrical heating element 20 for communicating radiant heat energy to melt chamber 7 and thermoplastic material 1 therein. Optionally, mechanical feed mechanism 4 is shown generally within body portion 12 for applying pressure to the solid portion of flexible thermoplastic rod 1 for forcing it along glue path 6, into melt chamber 7 and finally dispensing the melt through exit nozzle 8.

Handle 14 also has switch control pedestal 30 and mechanism 32, well known in the art, for locking battery/base unit 16 to handle 14. Switch pedestal 30 includes diode light 34, usually of green color but which may be of any desired color, switch 36 (S1) that controls power only to heating element 20, via sensor 23, as will be described in greater specificity below, while switch 38 (S2) increases the duty cycle or pulse widths from control circuit 24 to accommodate higher adhesive throughput. Manual control switch 40, which will be explained in detail hereafter, has multiple positions such as low, medium and high (or alternative are preset activate pre-set temperature levels) that can be selected by the user to designate the heat desired to be produced by heating element 20. Alternative, the positions on manual control switch 40 are preset for predetermined melts, for instance one position preset to correspond with 380° F. (193° C.) for using hot melt adhesives and another position on manual control switch 40 are preset to correspond to 225° F. (107° C.) for using cool melt adhesives.

Figure 2:
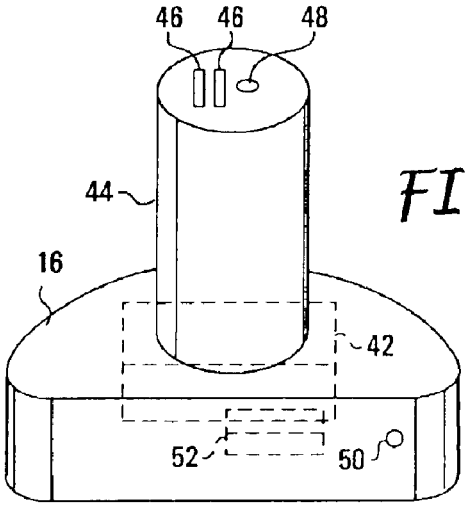
FIG. 2 is a perspective view of the novel battery that can be attached to the adhesive dispenser appliance as shown in FIG. 1 in accordance with an exemplary embodiment of the present invention.

FIG. 2 depicts an exemplary base/power unit 16 which includes battery 42 and stem 44 that can be inserted into handle 14 of dispensing appliance 10 shown in FIG. 1 and electrical terminals 46 to be received by appropriate terminals (not shown) in the handle 14 of the dispensing appliance 10 illustrated in FIG. 1. The battery/base 16 may be constructed such that stem 44 can be inserted in handle 14 in only one direction. This may take many different forms such as slot 48 on one side of connectors 46. Other versions could be to shape the cross-sectional area of stem 44 to be inserted in a corresponding receptacle shape in handle 14 as shown in FIG. 1. Battery/base 16 may include connector jack 50 for receiving a charging connector from the device in FIG. 3. As stated previously, that charging connector may be an AC voltage from an alternating current source if battery/base 16 has rectifier unit 52. This would allow a unit to be charged while it is mounted on blower/dryer 10 as well as an additional separate unit that can be charged at the same time. Moreover, dispensing appliance 10 is operable in on three modes: as portable unit using battery 42 as a power source; as a wired unit connected to an AC current source and using rectified AC current from rectifier unit 52 as a power source; or finally, as a wired unit connected to an AC current source but using battery 42 as a power source while simultaneously rectifying AC current from rectifier unit 52 and charging battery 42.

Figure 3:
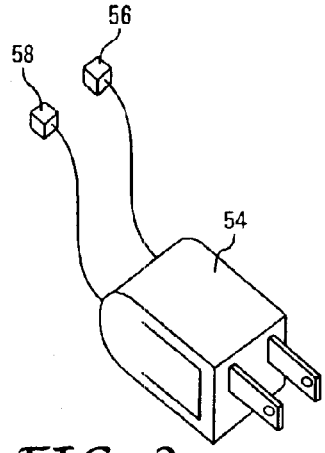
FIG. 3 is a schematic representation of a converter for supplying either AC or DC power 0to the battery for charging thereof in accordance with an exemplary embodiment of the present invention.

Note in FIG. 3 that plug-in unit 54 could generate either AC or DC power output voltage on jacks 56 and 58. If the battery unit has its own rectifier unit 52, then jacks 56 and 58 in FIG. 3 may generate AC voltage. If the battery unit is selected that does not have rectifier 52, then plug-in unit 54 must be an AC to DC converter and jacks 56 and 58 would generate DC voltage. Here it should be understood that battery 42 may be any known, or heretofore unknown, type of power source without departing from the intended scope of the present invention. For example, battery 42 may be any of a dry cell, wet cell, alkaline, nickel-cadmium (Ni-Cad), fuel cell or any other chargeable or disposable portable source of AC or direct current (DC) power. Moreover, the power source need not be portable, but instead may be connection (wired) to any regulated source of AC or DC power, such as a typical 110 volt (60 hz) US standard wall outlet or equivalent 220 volt (50 hz) international standard outlet. The power may originate from any generation source whatsoever. The weight of base 16 is in balance with the weight of the elongated body portion. Such balance can be easily achieved by those skilled in the art.

It will be noted in FIG. 1 that handle portion 14 has a longitudinal axis extending substantially transversally from and along mass center line 18 of elongated body portion 12. Again, base unit 16 in FIG. 1 also has a mass center line that, when attached to the handle portion, lies substantially along the longitudinal axis of mass center line 18 such that (I) power can be supplied to manual controls 30 and (2) flat base 16 may provide a structure for enabling the adhesive dispensing appliance to stand alone.

Figure 4A:
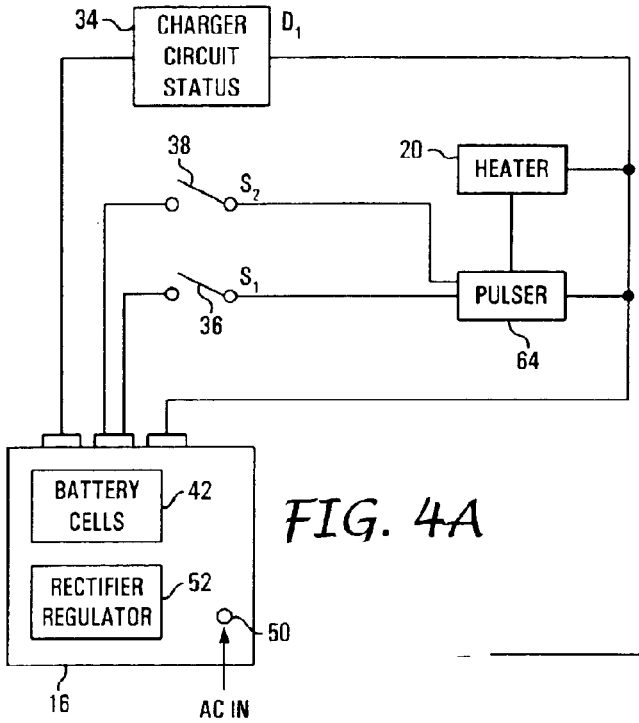
FIG. 4A is a block diagram of the control circuit for controlling the power to the blower fan and to the heating element in accordance with an exemplary embodiment of the present invention.

FIG. 4A discloses the basic electrical circuit for controlling power to the heating element. Basic circuit 62 includes battery base portion 16 with battery cells 42 therein and, if desired, rectifier unit 52. It also has jack 50 for connecting a charger thereto. When the unit is plugged into a power source, the power is immediately supplied to LED 34 which indicates that the battery has sufficient power to operate the unit. When switch button 36 ($S_1$) is depressed, power is coupled to heating element 20 through a pulsing circuit 64, if desired. Switch button 38 ($S_2$) is a "super button." By depressing switch button 38 ($S_2$), the duty cycle or pulse widths from control circuit pulsing circuit 64 is increased for accommodate higher usage rates. Pulsing circuit 64 will be described hereafter.

Figure 4B:
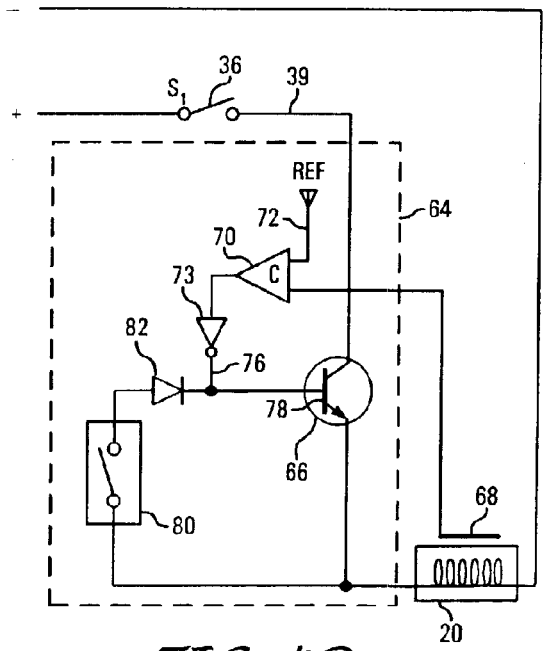
FIG. 4B is a circuit illustrating one circuit embodiment for quickly heating the heating element and then supplying pulsed current or voltage to maintain the heat in accordance with an exemplary embodiment of the present invention.

Pulsing circuit 64 is shown in detail in FIG. 4B. When the unit is first turned on and switch 36 ($S_1$) is depressed, the heating element is energized and it is desired that the heating element heat as quickly as possible. Thus, as shown in FIG. 4B, when switch 36 is closed, conductor 39 is coupled directly to the input of transistor 66. The temperature of heating element 20 is monitored by a temperature sensor, such as a thermocouple or thermistor. Temperature sensor 68 is coupled to comparator 70. Another voltage reference 72 is coupled to the other input of the comparator representing the proper or maximum heating temperature of element 20. Since there is no heat at first, there is no output from comparator 70. That lack of signal is detected by inverting diode 73 which generates an output signal on line 76 that is coupled to base 78 of power transistor 66 causing it to conduct. Transistor 66 is turned on by the signal on output line 76. Thus, full voltage is applied to heating element 20 to provide maximum heating in minimum time. As soon as the element is heated to the desired temperature, and that is sensed by sensor 68, an output signal is generated by comparator 70 that causes inverting diode 73 to remove its signal on output line 76 thus removing the continuous signal from the base 78 of transistor 66. At this time, pulser circuit 80, which is isolated from inverting diode 73 by isolating diode 82, provides pulses to base 78 of transistor 66 to maintain the heat attained by heating element 20 without having a continuous voltage applied thereto.

Figure 4C:
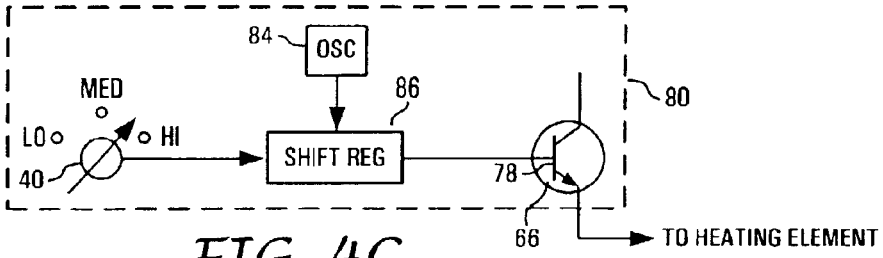
FIG. 4C illustrates the details of the pulsing circuit illustrated in FIG. 4B in accordance with an exemplary embodiment of the present invention.
Figure 4D:
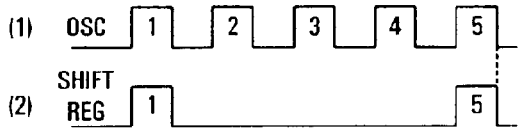
FIG. 4D illustrates in waveform 1 the oscillator output, and in waveform 2 the output of a circuit illustrating a 1:4 ratio for applying pulses to the heating element in accordance with an exemplary embodiment of the present invention.

Pulser circuit 80 is shown in detail in FIG. 4C in accordance with one exemplary embodiment of the present invention. Oscillator 84 applies pulses to circuit 86 that could be a shift register, a timer, a counter, or a divider circuit as shown in U.S. Pat. No. 4,571,588, which is incorporated herein by reference in its entirety. The duty cycle is the percentage of time a unit is used, or the ratio of operation time to shutdown time. If device capable of only fixed length pulses is used for controlling the duty cycle, then ration can be adjusted only by designating more or less pulses as operation pulses. If, however, the period of the pulses can also be altered, then the duty cycle can be altered by either increasing the ratio of the operation pulses to shutdown pulses, or by lengthening the duration of the operation pulses in the cycle. Thus, selecting a device having output pulse width modulation capability allows for adjusting the duration of the operation period as well as the ratio of operation periods. Many types of times and shift registers known in the art have pulse width modulation capabilities. In accordance with one exemplary embodiment, circuit 86 may be a 4-bit shift register as depicted in FIG. 4C. Input switch 40 is used for selecting select low, medium and high heat, causes a selected bit from one stage of circuit 86 to be connected to base 78 of transistor 66 thus causing transistor 66 to be pulsed on and off at a given rate. An example is illustrated in FIG. 4D. The oscillator is shown to have 5 pulses in waveform "1 " of FIG. 4D while circuit 86 generates an output pulse only once for every four input pulses as shown in waveform "2" which means there is a 4:1 ratio of the operating time of transistor 66. For every four pulses received by circuit 86, only one is gated to transistor 66 allowing transistor 66 to power heating element 20 only one-fourth of the time possible for heating (i.e., one-fourth of the duty cycle). The duty cycle may be increased by adding pulses or by increasing the pulse width of output of circuit 86.

Figure 4G:
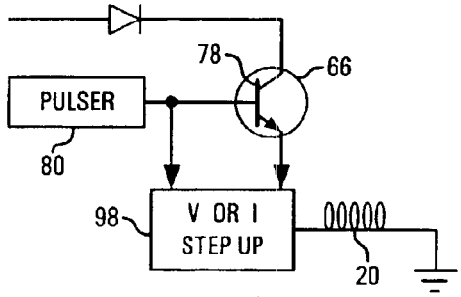
FIG. 4G illustrates a circuit for stepping up the voltage or current only during the time the pulses are applied to the heating element in accordance with an exemplary embodiment of the present invention.
Figure 4E:
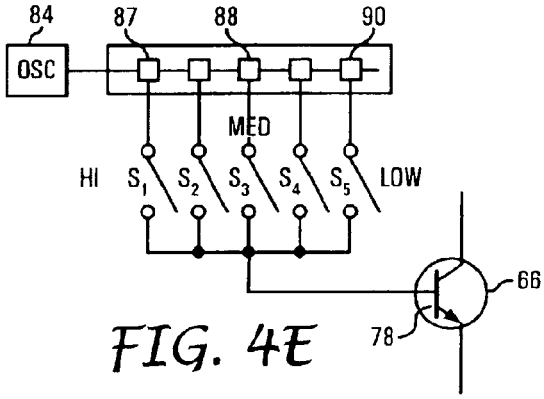
FIG. 4E is a schematic illustration of the output circuit with a manual switch control being set to high, medium and low to provide pulses and pulse ratios to the power transistor that supplies voltage and current to the heating element in accordance with an exemplary embodiment of the present invention.

Other ratios could be selected as illustrated by the circuit in FIG. 4E where oscillator 84 is feeding the pulses to circuit 86. At the output of each of the four stages or dividers of circuit 86, a switch ($S_1$–$S_5$) is connected to base 78 of transistor 66. If, for instance, switch $S_1$ is selected as the high heat position, then circuit 86, at stage 87, will produce an output with every pulse received and applied to base 78 of transistor 66. If stage 88 is selected by closing switch ($S_3$) or placing switch 40 in the medium position, then third stage 88 will be selected and a pulse will be generated through switch $S_3$ to base 78 of transistor 66 with every third pulse of the oscillator or a 1:3 ratio. In like manner, if stage 90 is selected with selector position switch 40 in the low position, then every fourth pulse presented to circuit 86 will be counted and be produced through switch $S_5$, the low position, to base 78 of transistor 66 thus having a 1:4 heating ratio. It can be readily seen that such a circuit cannot only control the amount of heat generated by heating element 20, but also maintain the heat with less power requirements since it simply adds enough heat at periodic intervals to maintain a given heat. Thus, power is saved and the unit is more economically efficient and the battery life is prolonged. Implementing a duty cycle has an additional benefit that is not immediately apparent, that is, extending appliance life. Because the heating element is not operating the full time period the appliance is switched on, the useful life of the heating element is extended.

Figure 4H:
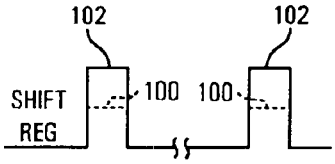
FIG. 4H illustrates the stepped-up voltage pulses that are applied to the heating element by the circuit of FIG. 4G in accordance with an exemplary embodiment of the present invention.
Figure 4F:
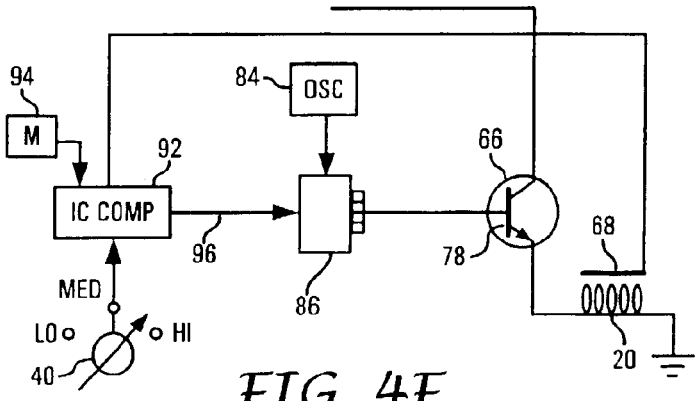
FIG. 4F illustrates a circuit for supplying pulses to the power transistor to automatically maintain a desired heater temperature utilizing an innovative control circuit in accordance with an exemplary embodiment of the present invention.

In accordance with still another exemplary embodiment of the present invention, automatic temperature control of heating element 20 is achieved through the circuit depicted in FIG. 4F. As can be seen in FIG. 4F, an integrated circuit controller 92 is added as an integrated circuit chip with memory 94 that stores a table comparing detected temperature versus counter 86 output. When hand controller 40 is set to a position of low, medium or high, that position is detected by integrated circuit controller 92 which then compares the temperature table with the actual temperature received from sensor 68 and through line 96 causing the proper output of counter 86 to be applied to the base of transistor 66 to supply the proper voltage or current to heating element 20 to cause it to reach the set temperature. The table in memory 94 stores temperature to count maps for each position on manual control switch 40. For example, one position preset to correspond with 380° F. (193° C.) for using hot melt adhesives and another position on manual control switch 40 are preset to correspond to 225° F. (107° C.)for using cool melt adhesives. Alternatively, table in memory 94 may store temperature to count map-biased on the desired temperature associated with each position on manual control switch 40. In that case, the greater the differential between the actual temperature, as detected by sensor 68, and the desired temperature, as indicted by the position of manual control switch 40, the longer the duty cycle. This allows for rapid recovery for higher usage and substantially increases throughput.

In accordance with another exemplary embodiment of the present invention, current or voltage to the heating element may be increased during the time the pulse is applied through the transistor 66. Thus, in FIG. 4G, each time pulser circuit 80 applies a pulse to base 78 of transistor 66, it also applies a pulse to a voltage or current step-up device 98 to increase the current or voltage to heating element 20. Such voltage step-up device could be, for instance, a piezoelectric device, well known in the art, that, when voltage is applied to the device in one direction, causes a step-up voltage that may be detected in another direction of the piezoelectric device. Voltage and current step-up devices are well known in the art and will not be described in any further detail here. Optionally, device 98 may be selectively activated by couples a switch, such as switch 36 ($S_2$) between pulser 80 and device 98, thereby activating voltage and current step-up device 98 only after manual intervention by the operator. Alternatively, device 98 may be activated automatically based on the temperature of melt chamber 7 as sensed by sensor 68.

FIG. 4H illustrates how the pulse is increased in magnitude. Normally the pulse is at height 100, but a step-up to height 102 is caused by step-up unit 98. This increases the speed of heating of the element to the desired temperature. Further, to maintain a desired heat with such increased pulse could mean that a higher pulse ratio could be used. That is, for example only, one pulse out of five instead of one pulse out of three or four could be used.

While the present invention has been described with reference to an exemplary portable adhesive dispensing appliance which dispenses melt adhesive from "glue sticks," one of ordinary skill level in the relevant art would readily understand that the principles and concepts discussed herein are equally relevant for other types of appliances. One such appliance is an industrial adhesive dispensing appliance which holds bulk adhesives in a melt reservoir and forces the hot melt to the dispensing gun through an insulated hose. The techniques described herein with regard to the present invention may be incorporated in the melt reservoir of such an appliance. Moreover, often the dispensing gun contains a secondary heating element for re-heating the melt to the ideal temperature for application onto a workpiece. In those cases, both the primary heating element of the melt reservoir and the secondary heating element in the dispensing gun may be controlled by pulse circuits as described herein above.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. An adhesive dispensing appliance with adjustable duty cycle comprising:

a body portion;

an adhesive path traversing at least a portion of the body portion;

at least one electrical heating element, said at least one electrical heating element for radiating heat to at least a portion of the adhesive path;

a power source electrically coupled to the at least one electrical heating element, wherein said power source provides power to said at least one electrical heating element; and a pulsing circuit electrically coupled between said power source and said at least one electrical heating element for enabling manual adjustment of the pulse duty cycle applied to said at least one electrical heating element thereby establishing a variable duty cycle enabling stored static heat of said at least one electrical heating element to be expended and replenished periodically with the variable duty cycle.

2. The adhesive dispensing appliance of claim 1, further comprising a switch electrically coupled between said power source and said at least one electrical heating element and operated by the pulsing circuit.

3. The adhesive dispensing appliance of claim 1, wherein said pulsing circuit further comprises a circuit for supplying continuous power to said at least one electrical heating element.

4. The adhesive dispensing appliance of claim 3, wherein said circuit for supplying continuous power comprises:

a sensor for sensing an at least one electrical heating element temperature and generating a corresponding signal;

a comparator for comparing a reference signal to said sensed signal and providing a first output; and a power transistor electrically coupled between said power source and said at least one electrical heating element, said power transistor further having a trigger electrically coupled to said comparator, wherein said power transistor provides continuous power to said at least one electrical heating element based on the first output.

5. The adhesive dispensing appliance of claim 4, wherein said pulsing circuit further comprises:

a pulse generating circuit electrically connected to said trigger of said power transistor for providing output pulses to said trigger of said power transistor at one of a plurality of on/off rates for providing modulated power to said at least one electrical heating element based on the output pulses.

6. The adhesive dispensing appliance of claim 5 further comprising a manual control coupled to said pulse generating circuit for selecting one of the plurality of desired on/off rates for providing power to said at least one electrical heating element.

7. The adhesive dispensing appliance of claim 6 further comprising:

a voltage step-up circuit coupled between said power transistor and said at least one electrical heating element and coupled to said pulse generating circuit in parallel with said power transistor for receiving said on/off rate, said voltage step-up circuit providing a voltage step-up to said at least one electrical heating element synchronously with said trigger of said power transistor receiving pulses at said on/off rate.

8. The adhesive dispensing appliance of claim 5, wherein said pulser circuit further comprises:

an oscillator circuit for generating sequential pulses;

a circuit for receiving said sequential pulses, said circuit comprising a plurality of serial stages, each of the plurality of serial stages generating an output pulse in response to receiving a particular pulse in said sequential pulses;

a plurality of multiple position switches, each of the plurality of multiple position switches electrically coupled between one of said plurality of serial stages and said trigger of said power transistor; and means for positioning at least some of said plurality of multiple position switches for passing at least one of said output pulses from one of the plurality of serial stages to said trigger of said power transistor at said on/off rate.

9. The adhesive dispensing appliance of claim 8 further comprises:

means for manually selecting an element temperature; and an integrated circuit controller having a memory and a table stored in said memory indicating heating element temperature versus pulse rate, said integrated circuit controller coupled to said means for manually selecting and coupled between said heating element heat sensor and said trigger of said power transistor for receiving the selected element temperature from said means for manually selecting and receiving the corresponding signal from said heating element heat sensor, and in response to the selected element temperature, the corresponding signal and indications from said table stored in the memory of the integrated circuit controller generating a control signal for controlling said on/off rate to said trigger of said power transistor.

10. The adhesive dispensing appliance of claim 9, wherein said control signal for controlling said pulse rate forming said means for positioning at least some of said plurality of multiple position switches for designating a pulse rate.

11. The adhesive dispensing appliance of claim 5 further comprises:

means for manually selecting an element temperature; and an integrated circuit controller having a memory and a table stored in said memory indicating at least one electrical heating element temperature versus pulse rate, said integrated circuit controller coupled to said means for manually selecting and further coupled between said at least one electrical heating element heat sensor and said trigger of said power transistor for receiving the selected element temperature from said means for manually selecting and receiving the corresponding signal from said at least one electrical heating element heat sensor and in response to the selected element temperature, the corresponding signal and indications from said table stored in the memory of the integrated circuit controller, generating a control signal for controlling said on/off rate to said trigger of said power transistor.

12. The adhesive dispensing appliance of claim 1, wherein said pulsing circuit further comprises:

a power transistor having an input electrically coupled to said power source, and output electrically coupled to said at least one electrical heating element and a trigger; and a pulse generating circuit electrically connected to said trigger of said power transistor for providing variable duty cycle output pulses to said trigger of said power transistor at one of a plurality of on/off rates for providing adjustable power to said at least one electrical heating element based on the output pulses.

13. The adhesive dispensing appliance of claim 12 further comprising a manual control coupled to said pulse generating circuit for selecting one of the plurality of desired on/off rates for providing power to said at least one electrical heating element.

14. The adhesive dispensing appliance of claim 12, wherein said pulser circuit further comprises:

an oscillator circuit for generating sequential pulses;

a circuit for receiving said sequential pulses, said circuit comprising a plurality of serial stages, each of the plurality of serial stages generating an output pulse in response to receiving a particular pulse in said sequential pulses;

a plurality of multiple position switches, each of the plurality of multiple position switches electrically coupled between one of said plurality of serial stages and said trigger of said power transistor; and means for positioning at least some of said plurality of multiple position switches for passing at least one of said output pulses from one of the plurality of serial stages to said trigger of said power transistor at said on/off rate.

15. The adhesive dispensing appliance of claim 14 further comprises:

a sensor for sensing a heating element temperature and generating a corresponding signal;

means for manually selecting an element temperature; and an integrated circuit controller having a memory and a table stored in said memory indicating heating element temperature versus pulse rate, said integrated circuit controller coupled to said means for manually selecting and coupled between said heating element heat sensor and said trigger of said power transistor for receiving the selected element temperature from said means for manually selecting and receiving the corresponding signal from said heating element heat sensor, and in response to the selected element temperature, the corresponding signal and indications from said table stored in the memory of the integrated circuit controller generating a control signal for controlling said on/off rate to said trigger of said power transistor.

16. The adhesive dispensing appliance of claim 15, wherein said control signal for controlling said pulse rate forming said means for positioning at least some of said plurality of multiple position switches for designating a pulse rate.

17. The adhesive dispensing appliance of claim 12 further comprises:

a sensor for sensing a heating element temperature and generating a corresponding signal;

means for manually selecting an element temperature; and an integrated circuit controller having a memory and a table stored in said memory indicating heating element temperature versus pulse rate, said integrated circuit controller coupled to said means for manually selecting and coupled between said heating element heat sensor and said trigger of said power transistor for receiving the selected element temperature from said means for manually selecting and receiving the corresponding signal from said heating element heat sensor, and in response to the selected element temperature, the corresponding signal and indications from said table stored in the memory of the integrated circuit controller generating a control signal for controlling said on/off rate to said trigger of said power transistor.

18. The adhesive dispensing appliance of claim 6 further comprising:

a voltage step-up circuit coupled between said power transistor and said at least one electrical heating element and coupled to said pulse generating circuit in parallel with said power transistor for receiving said on/off rate, said voltage step-up circuit providing a voltage step-up to said at least one electrical heating element synchronously with said trigger of said power transistor receiving pulses at said on/off rate.

19. The adhesive dispensing appliance of claim 1 wherein said power source contains at least one rechargeable battery.

20. The adhesive dispensing appliance of claim 19 wherein said battery supplies at least 14 volts to said manual controls.

21. The adhesive dispensing appliance of claim 19 further comprises:

an AC/DC rectifier circuit forming part of said power source; and said AC/DC rectifier receiving the output of an AC charging circuit for enabling DC voltage to be generated for charging said at least one battery.

* * * * *